US005098362A

United States Patent [19]

Van Davelaar

[11] Patent Number: 5,098,362

[45] Date of Patent: * Mar. 24, 1992

[54] SPIRAL TUBE MAKING METHODS AND APPARATUS INCLUDING SPLICE REJECTION

[75] Inventor: Peter C. Van Davelaar, Richmond, Va.

[73] Assignee: Philip Morris Incorporated, New York, N.Y.

[ * ] Notice: The portion of the term of this patent subsequent to Jul. 9, 2008 has been disclaimed.

[21] Appl. No.: 688,479

[22] Filed: Apr. 22, 1991

Related U.S. Application Data

[63] Continuation of Ser. No. 493,718, Mar. 15, 1990, Pat. No. 5,030,188.

[51] Int. Cl.[5] ..... B31C 3/00

[52] U.S. Cl. ..... 493/16; 493/12; 493/22; 493/288

[58] Field of Search ..... 493/10, 11, 12, 16, 493/24, 22, 288, 290, 299, 302

[56] References Cited

U.S. PATENT DOCUMENTS

| | | | |
|---|---|---|---|
| 388,462 | 8/1888 | Tainter . | |
| 3,136,231 | 6/1964 | Hoyt . | |
| 4,378,966 | 4/1983 | Schumacher | 493/290 |
| 4,473,368 | 9/1984 | Meyer | 493/34 |
| 4,486,186 | 12/1984 | Grumer | 493/16 |

OTHER PUBLICATIONS

Industrial Electronics, "Photoelectric Register Controls", p. 39, FIG. 3, Jan. 1960.

*Primary Examiner*—Bruce M. Kisliuk
*Assistant Examiner*—John A. Marlott
*Attorney, Agent, or Firm*—Robert R. Jackson

[57] ABSTRACT

In apparatus for forming cut lengths of tube by winding one or more strips of material into a continuously advancing spiral wound tube and periodically cutting off lengths of the tube, lengths of tube containing splices present in the strips are rejected at a rejection point downstream from the cut-off point by monitoring the strips for splices prior to winding, waiting until enough strip has passed the splice monitoring point to extend from the splice monitoring point to the rejection point, and rejecting the length of tube at the rejection point when that amount of strip has passed the splice monitoring point.

3 Claims, 4 Drawing Sheets

SPIRAL TUBE MAKING METHODS AND APPARATUS INCLUDING SPLICE REJECTION

This is a continuation of application Ser. No. 493,718 filed Mar. 15, 1990 now U.S. Pat. No. 5,030,188.

BACKGROUND OF THE INVENTION

This invention relates to spiral tube making methods and apparatus, and more particularly to rejecting finished tube sections which include splices in any one of the constituent strips or tapes.

Machinery for making spiral wound tubes from one or more input strips or tapes of paper, plastic, metal foil, or the like are well known as shown, for example, by Meyer U.S. Pat. No. 4,473,368. The strips are typically supplied from large rolls or reels, and in order to keep the machine running continuously or substantially continuously, it is desirable to splice the trailing end of each supply roll which is about to be exhausted to the leading end of a new roll. The problem with doing this is that the splice becomes part of one or possibly two or more adjacent lengths of finished tube. Although splices may be difficult to automatically detect in the finished tube, they frequently render the affected tube lengths unacceptable or at least undesirable for their intended use (e.g., by locally increasing their thickness, outer circumference, weight, etc.). A way to identify and reject tube lengths containing splices is therefore needed.

In view of the foregoing, it is an object of this invention to improve spiral tube winding methods and apparatus.

It is a more particular object of this invention to provide spiral tube winding methods and apparatus which can detect a splice in any of the strips or tapes going to the winding mechanism and reject the length (or lengths) of finished tube containing such a splice.

SUMMARY OF THE INVENTION

These and other objects of the invention are accomplished in accordance with the principles of the invention by providing spiral tube winding apparatus including means associated with each of the strips going to the tube winding mechanism for producing an output signal when a splice in the associated strip is detected. A resettable meter or counter is also associated with each strip. Each meter is reset by the output signal of the associated splice detector and produces an output signal after a predetermined amount of strip has been supplied to the winding mechanism after the meter was reset. The predetermined amount of strip is chosen to be the amount needed to allow a splice to travel from the location of the associated splice detector to a finished tube length rejection mechanism which is located downstream from the point at which finished lengths of tube are cut off. When the finished tube length rejection mechanism receives an output signal from any of the meters, it rejects the finished tube length currently at the location of the rejection mechanism. In order to ensure rejection of all finished tube lengths which may contain all or part of a splice, each meter may be set up to produce the above-mentioned output signal from a meter count slightly prior to the expected arrival of a splice at the finished tube length rejection mechanism to a meter count slightly after that expected arrival This may result in the rejection of some good tube lengths, but it will definitely ensure the rejection of all splice-containing tube lengths.

Further features of the invention, its nature and various advantages will be more apparent from the accompanying drawings and the following detailed description of the preferred embodiments.

BRIEF DESCRIPTION OF THE DRAWINGS

FIG. 2 shows the side edge of a typical strip 12*a*.

FIG. 3 shows the side edge of another typical strip 12*b*.

DETAILED DESCRIPTION OF THE PREFERRED EMBODIMENTS

Figure 1:
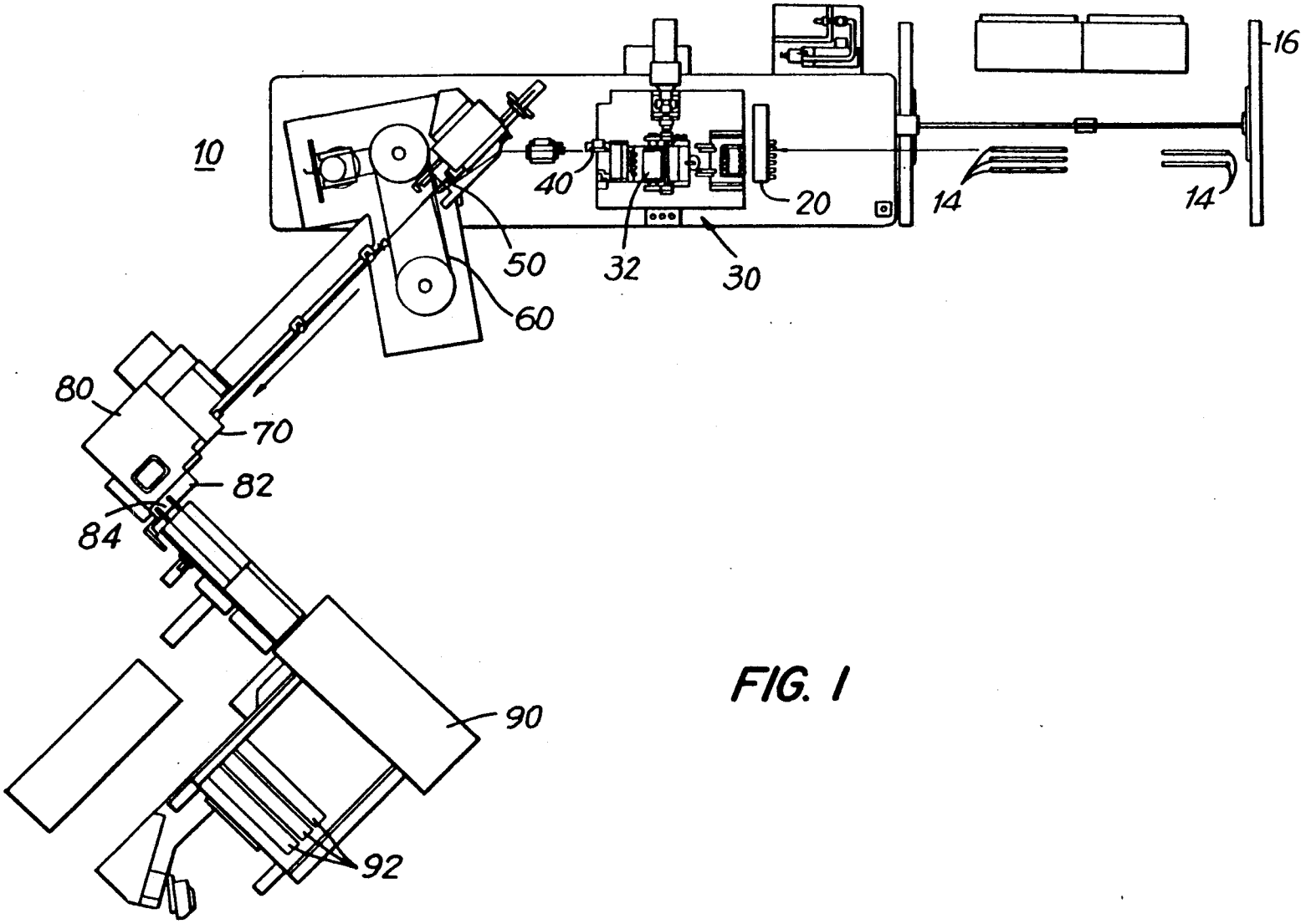
FIG. 1 is a plan view of an illustrative embodiment of tube winding apparatus constructed in accordance with the principles of this invention.

The illustrative tube winding apparatus 10 shown in FIG. 1 is capable of winding tubes made up of as many as five strips or plies. The strips 12 are fed in side-by-side (moving to the left as viewed in FIG. 1) from supply rolls 14 removably mounted on bobbin stand 16. (The strips themselves are not shown in FIG. 1 to avoid cluttering the drawing. Typical strips 12*a* and 12*b* are, however, shown in FIGS. 2 and 3.) The strips on rolls 14 may have splices at various points along their length Alternatively, or in addition, splices may be formed in the strips when the trailing end of the strip from one roll (e.g., a nearly exhausted roll) is joined to the leading end of the strip from a new roll.

As each strip enters the tube winding machine, it passes splice detect assembly 20. Splice detect assembly 20 includes a splice detector (discussed in more detail below) associated with each strip for detecting a splice in the associated strip.

From splice detect assembly 20 the strips move (to the left as viewed in FIG. 1) through apparatus 30 (described in greater detail in concurrently filed, commonly assigned U.S. patent application Ser. No. 493,755, now U.S. Pat. No. 5,019,024 which performs such tasks as appropriately tensioning each strip and applying glue from glue roller 32 to at least some of the strips. As the strips leave apparatus 30, one of the strips—preferably the strip that will be on the inside of the finished tube—passes in contact with meter wheel 40 so that the strip causes the meter wheel to rotate at the same peripheral speed that the strip is travelling. Meter wheel 40 includes apparatus 110 (FIG. 4) for producing an output signal pulse after each predetermined amount of rotation of the wheel. Accordingly, the frequency of these output signal pulses indicates the speed at which the strip in contact with meter wheel 40 is travelling.

From apparatus 30 the strips continue (to the left as viewed in FIG 1) until they reach and wrap around mandrel 50. Belt 60 is wrapped around the strips on mandrel 50 and is driven to cause the strips to be pulled toward and wrap around the mandrel, thereby forming a continuous spiral-wound tube on the mandrel. Belt 60 also causes this tube to continuously advance along mandrel 50 toward the lower left as viewed in FIG. 1. By the time the tube has reached the end of mandrel 50 (prior to cutter 70), the glue (applied at glue roller 32 as described above) has set sufficiently to allow further processing of the tube as will now be described.

Figure 4:
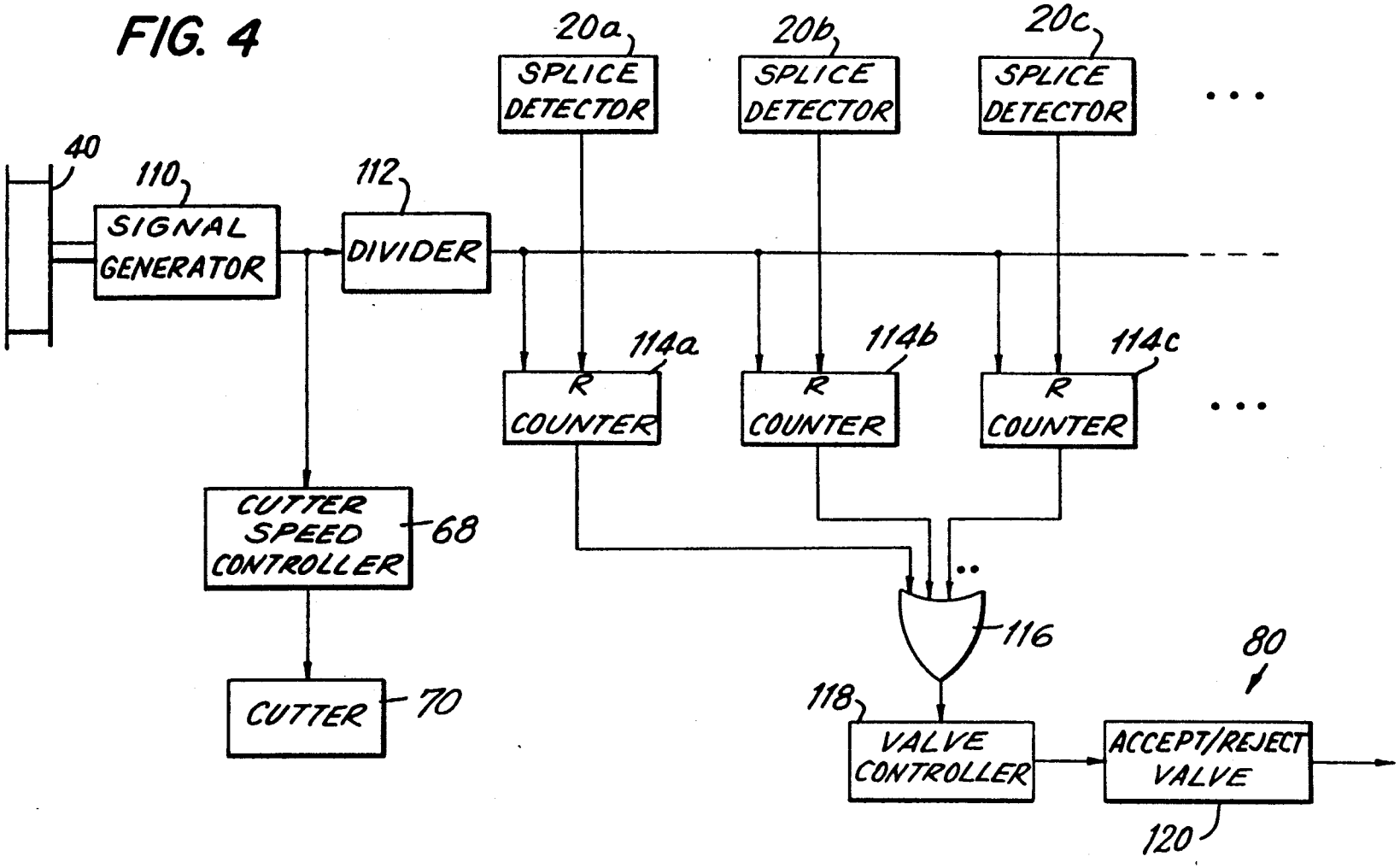
FIG. 4 is a schematic block diagram of an illustrative embodiment of a control circuit constructed in accordance with the principles of this invention.

Cutter 70 periodically cuts transversely through the continuously advancing tube to produce finished lengths of tube of predetermined length. These finished lengths of tube continue to advance lengthwise one after another into accept/reject mechanism 80. Cutter 70 (which may include a continuously rotating cutter wheel) is preferably synchronized with the remainder of the apparatus so that cutter 70 produces finished lengths of tube of the desired length regardless of the speed of operation of the machine. For example, although it might be possible to synchronize cutter 70 with the drive for belt 60, in the particularly preferred embodiments cutter 70 is synchronized with meter wheel 40, e.g., as shown in FIG. 4. In particular, the output signal of signal generator 110 is applied to cutter speed controller 68 which controls the speed of cutter 70 in accordance with the speed of meter wheel 40. This is believed to be preferable to linking cutter speed to the speed of belt 60 because there may be an unknown amount of slippage between belt 60 and the tube forming on mandrel 50.

If a tube length has been selected for rejection as described in greater detail below (e.g., because it contains a splice from one of input strips 12), it is deflected to the side (e.g., by momentary interruption of an air flow required for continued travel of the tube along an axis extending from mandrel 50, or by any other suitable tube-diverting technique) and exits from the apparatus via reject chute 82. Otherwise the tube continues past reject chute 82 to accept chute 84 where it begins to be conveyed to the side toward tray filler 90. Tray filler 90 fills successive trays 92 with finished tubes and discharges the filled trays to allow the finished tubes to be conveyed to other apparatus (not shown) for use of the tubes.

Figure 2:
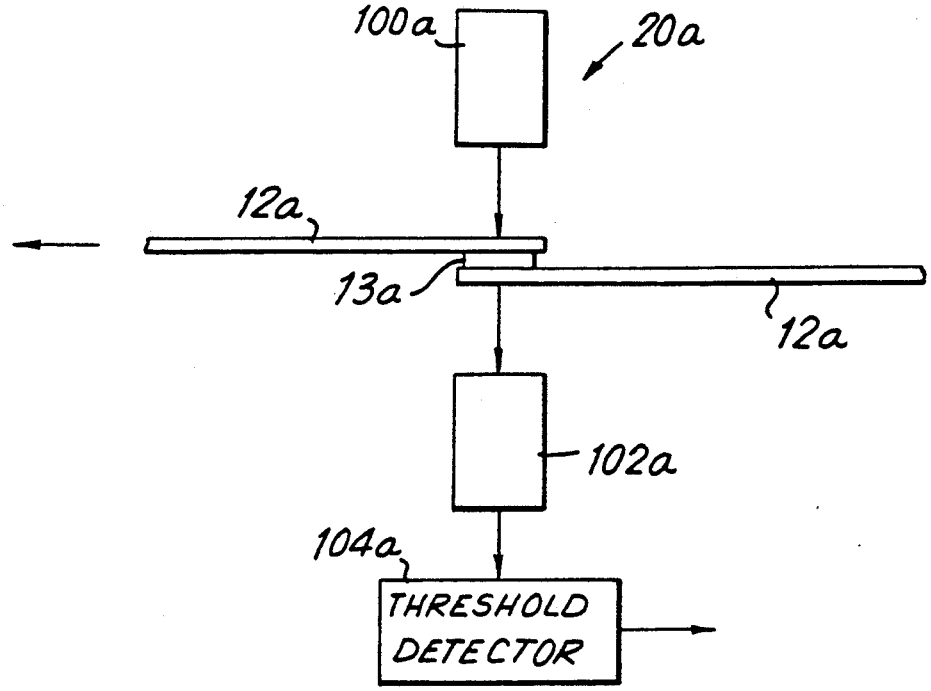
FIG. 2 is a simplified elevational view of an illustrative embodiment of a splice detector usable in accordance with this invention.
Figure 3:
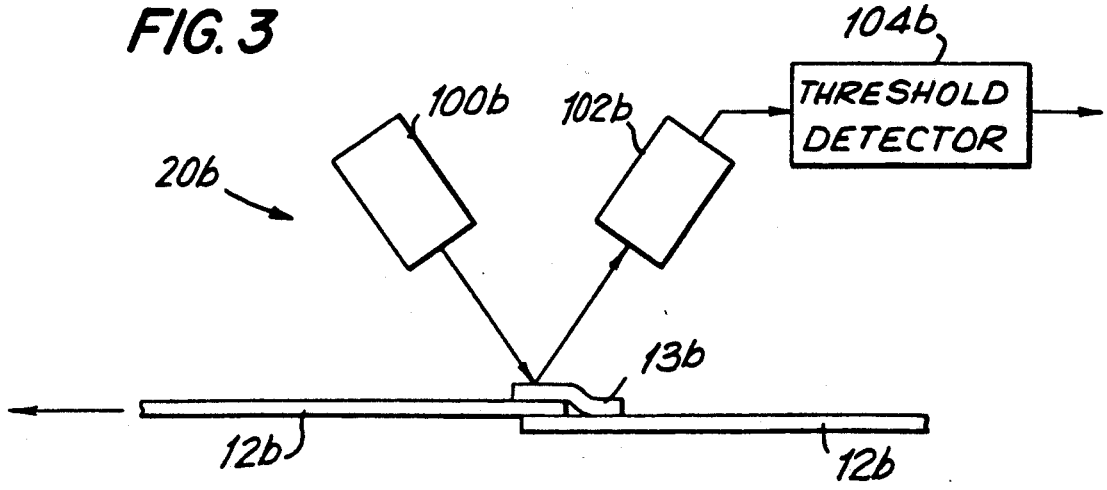
FIG. 3 is a view similar to FIG. 2 showing another illustrative embodiment of a splice detector usable in accordance with this invention.

FIGS. 2 and 3 illustrate two of the possible embodiments of splice detect assembly 20. In both cases the splice detection is performed optically, the choice of apparatus being based on the optical properties of the strip 12 being monitored. In FIG. 2 strip 12*a* is translucent (e.g., like paper) and spliced together by adhesive tape 13*a* which can be transparent, translucent, or opaque. Light from light source 100*a* is directed toward one side of strip 12*a*, and the light which passes through the tape is detected by photocell 102*a*. Photocell 102*a* produces an output signal proportional to the amount of light it receives. When only a single thickness of strip 12*a* is interposed between light source 100*a* and photocell 102*a*, photocell 102*a* receives a relatively large amount of light and produces an output signal having a first level. However, when a splice passes between elements 100*a* and 102*a*, the double thickness of strip material (and also possibly adhesive tape 13*a*) momentarily reduces the amount of light received by photocell 102*a* and causes the output signal of the photocell to momentarily shift to a second level Threshold detector 104*a* receives the output signal of photocell 102*a* and produces a binary output signal indicative of whether the photocell output has the first or the second level. Alternatively, threshold detector 104*a* can be described as producing an output signal indicative of the passage of a splice between elements 100*a* and 102*a*.

FIG. 3 illustrates an alternative optical splice detector arrangement 20*b* which can be used with strips 12*b* which are either opaque and reflective (e.g., foil or paper/foil laminates with the foil on the upper surface) or opaque and nonreflective (e.g., paper/foil laminates with the foil on the lower surface or sandwiched between paper layers). If strip 12*b* is opaque and reflective, then splicing tape 13*b* is selected to substantially attenuate the light from light source 100*b* that would normally reflect off the upper surface of strip 12*b* to photocell 102*b*. The apparatus therefore operates substantially similarly to detector 20*a* in FIG. 2. In particular, photocell 102*b* receives a relatively large amount of (reflected) light and produces an output signal having a first level except when a splice is present. When a splice is present, splice tape 13*b* momentarily reduces the amount of light received by photocell 102*b* and thereby causes that element to produce an output signal having a second level. Threshold detector 104*b* produces a binary output signal indicative of whether the photocell output signal has the first or the second level. The output signal of threshold detector 104*b* is therefore indicative of the passage of a splice.

If strip 12*b* is opaque and nonreflective, splicing tape 13*b* is selected to have a reflective upper surface. Photocell 102*b* therefore receives relatively little reflected light from light source 100*b* except when a splice is present. Although the polarity of the threshold detector output may be reversed as compared to the situation when strip 12*b* is reflective, the output signal of the threshold detector still indicates the passage of a splice. (Of course, the output of threshold detector 104*b* can be re-reversed by adding another simple logic element to the circuit.)

FIG. 4 shows an illustrative embodiment of the circuitry used to control a valve 120 (e.g., a pneumatic valve) which is part of accept/reject mechanism 80 in FIG. 1. The control of valve 120 is based on inputs from meter wheel 40 (described above in connection with FIG. 1) and splice detectors 20*a*, 20*b*, 20*c*, etc., each of which is associated with a respective one of strips 12 (as is also described above in connection with FIG. 1). Detectors 20 in FIG. 4 may, of course, be constructed as shown in FIGS. 2 and 3. As mentioned in the discussion of FIG. 1, signal generator 110 produces an output pulse each time meter wheel has rotated by a predetermined amount. Divider 112 may be provided, if desired, to reduce the frequency of the signal generator output signal pulses to a more convenient range. For example, divider 112 may divide the signal generator output signal frequency so that the divider produces one output signal pulse for each cut produced by cutter 70. Because this arrangement of divider 112 simplifies explanation of the remainder of the circuitry, it will be assumed that divider 112 operates in this manner.

The output signal of divider 112 is applied to the count input terminal of each of resettable counters 114*a*, 114*b*, 114*c*, etc., each of which is associated with a respective on of splice detectors 20*a*, 20*b*, 20*c*, etc. Each of counters 114 is reset by the output signal of the associated splice detector 20 which indicates that that splice detector has detected a splice in the associated strip 12. After being thus reset, each counter 114 counts the output pulses of divider 112 until again being reset by a splice-indicating output signal from the associated splice detector.

Each of counters 114 produces an output signal when the count registered by that counter reaches a predetermined value which corresponds to the time required for a splice to travel from the associated splice detector 20 to the location of reject chute 82 at the speed the machine is currently running. Note that the apparatus automatically adjusts itself to changes in machine operating speed because the pulses being counted by counters 114 are derived from meter wheel 40, the speed of which is governed by the speed of a representative strip 12 entering the machine. Each counter 114 therefore acts as a meter for measuring the amount of the associated strip 12 which has been pulled into the machine since that counter 114 was last reset by the detection of a splice in that strip 12.

OR gate 116 combines the output signals of counters 114 so that the OR gate produces an output signal pulse when any of counters 114 produces an output signal pulse. Valve controller 118 responds to an output signal pulse from OR gate 116 by operating accept/reject valve 120 so as to cause the length of tube currently adjacent to reject chute 82 to be diverted onto reject chute 82 and thereby prevented from reaching accept chute 84. Accordingly, any length of tube containing a splice from any of input strips 12 will be rejected by the apparatus.

If desired to provide greater assurance that every tube length containing all or part of a splice is rejected, counters 114 may be arranged to produce an output signal that will be passed by OR gate 116 while two or more successive counts are registered by the counter. In this way, for example, the apparatus can be arranged to reject not only the tube length expected to be at reject chute 82 when a splice detected by any of splice detectors 20 arrives at that location, but also to reject the tube length before that tube length and the tube length after that tube length. The number of successive tube lengths selected for rejection in this manner will depend on such factors as the length of each splice and the length of each cut length of tube.

Figure 5:
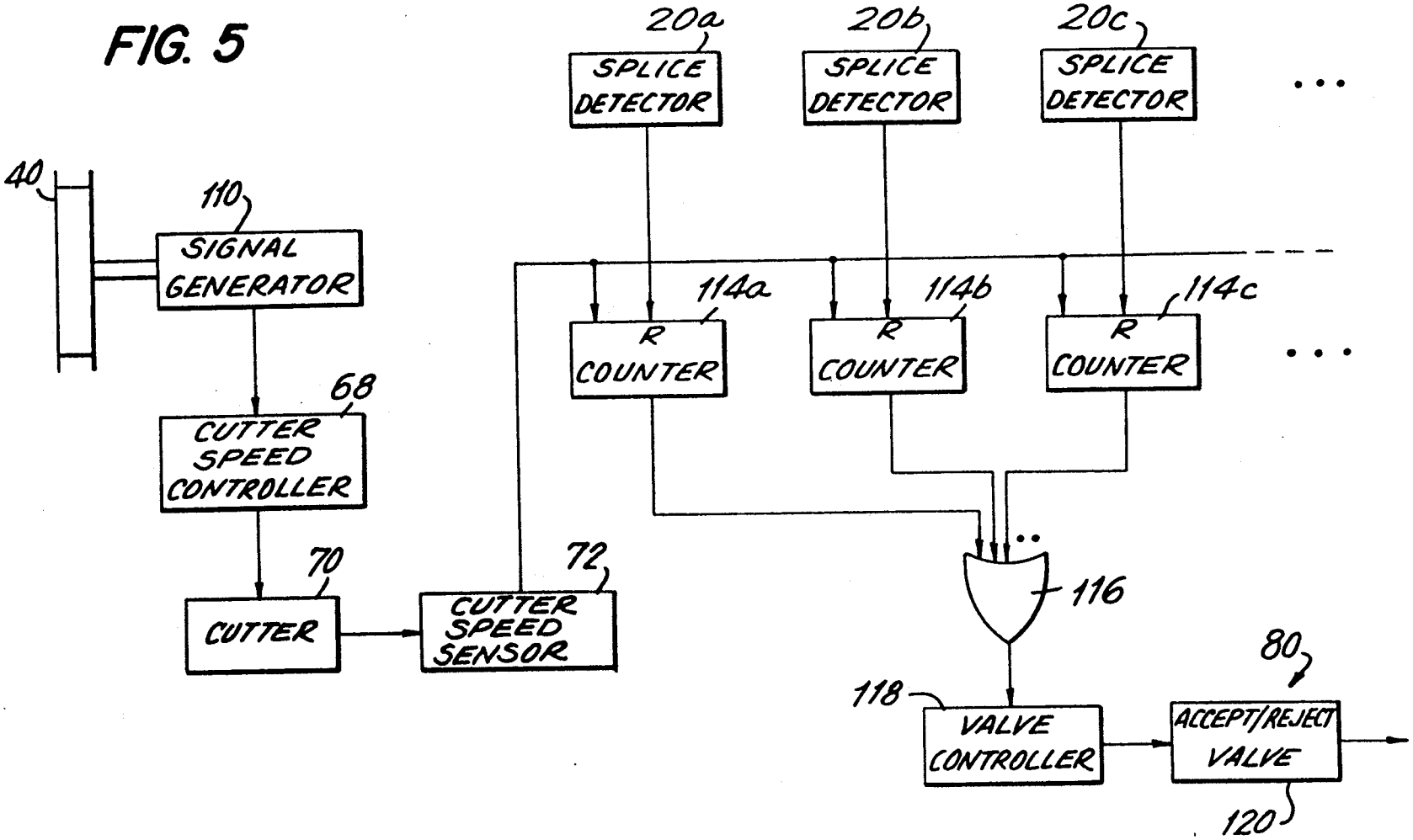
FIG. 5 is a schematic block diagram of an illustrative embodiment of an alternative embodiment of a control circuit constructed in accordance with the principles of this invention.

It will be understood that the foregoing is merely illustrative of the principles of this invention, and various modifications can be made by those skilled in the art without departing from the scope and spirit of the invention. For example, although FIG. 4 shows only enough circuitry for detecting splices in three strips 12, it will be understood that more circuits can be added in order to detect splices in any number of strips. As another example of modifications which can be made, the signal pulses counted by counters 114 in FIG. 4 (i.e., the signal pulses produced by divider 112 in FIG. 4) can instead be derived from revolutions of the cutter wheel in cutter 70 as shown in FIG. 5 (e.g., by providing a cutter speed sensor 72 such as a toothed wheel which rotates with the cutter wheel, and a proximity sensor which detects passage of each of the one or more teeth on that toothed wheel). Because cutter 70 is preferably synchronized with meter wheel 40 as described above, this alternative is functionally equivalent to using elements 40, 110, and 112 as in FIG. 4 to directly measure the length of a representative strip going to the mandrel. Accordingly, whether elements 40, 110, and 112 are used, or the above-described technique of monitoring revolutions of the cutter wheel is used, counters 114 still operate to meter the length of each strip which has gone into the tube since the last splice detected in that strip. The output signals of counters 114 therefore allow the rejection of any finished length of tube containing a splice as described in detail above.

The invention claimed is:

1. In apparatus for forming lengths of tube by winding a plurality of strips of material into a continuously advancing spiral wound tube and periodically cutting off lengths of said tube, each of said strips having splices along its length, the improvement comprising:

a meter shell having a circumferential surface in contact with one and only one of said strips as said on of said strips passes into said apparatus to be wound so that said meter wheel is rotated by lengthwise motion of said one of said strips;

means for generating an integral of the amount of rotation of said meter wheel;

a plurality of splice detectors, each of which is associated with a respective one of said strips, and each of which monitors the associated strip at a first location prior to winding in order to detect a splice in the associated strip and to produce a first output indication when a splice is thus detected in the associated strip;

means associated with each of said strips for responding to each first output indication of the splice detector associated with that strip by comparing said integral when said first output indication occurs to said integral subsequently and for producing a second output indication when the compared integrals indicate that a point on the associated strip has travelled from the first location associated with that strip to a second location downstream from the point at which said tube is periodically cut off; and means responsive to said second output indication associated with any of said strips for segregating the length of tube which is currently at said second location in order to reject any length of tube containing a splice from any of said strips.

2. The apparatus defined in claim 1 herein said means for generating an integral comprises:

means for producing an output signal pulse after each predetermined amount of rotation of said meter wheel; and a plurality of pulse counters, each of which is associated with a respective one of said strips, for counting the pulses produced by said means for producing.

3. The apparatus defined in claim 2 wherein said means associated with each of said strips for responding to each first output indication comprises:

means for resetting the pulse counter associated with a strip whenever the splice detector associated with that strip produces a first output indication, said second output indication being produced for that strip when the associated pulse counter reaches a predetermined count after being thus reset.

* * * * *